US008794275B2

(12) United States Patent
Gruber et al.

(10) Patent No.: US 8,794,275 B2
(45) Date of Patent: Aug. 5, 2014

(54) FILLING DEVICE

(75) Inventors: Wolfgang Gruber, Regenstauf (DE); Walter Neumayer, Worth/Donau (DE); Erwin Knieling, Pfatter (DE)

(73) Assignee: Krones AG, Neutraubling (DE)

( * ) Notice: Subject to any disclaimer, the term of this patent is extended or adjusted under 35 U.S.C. 154(b) by 561 days.

(21) Appl. No.: 13/105,191

(22) Filed: May 11, 2011

(65) Prior Publication Data

US 2011/0277881 A1 Nov. 17, 2011

(30) Foreign Application Priority Data

May 12, 2010 (DE) ..... 10 2010 028 953

(51) Int. Cl.
*B65B 31/00* (2006.01)
*B67C 3/22* (2006.01)
*B67C 3/26* (2006.01)

(52) U.S. Cl.
CPC ..... *B67C 3/22* (2013.01); *B67C 2003/2668* (2013.01)
USPC ..... 141/181; 141/144; 141/145; 141/284; 141/39

(58) Field of Classification Search
USPC ..... 141/39, 47, 54, 59, 144–152, 181, 266, 141/284
See application file for complete search history.

(56) References Cited

U.S. PATENT DOCUMENTS

| | | | | |
|---|---|---|---|---|
| 1,978,002 | A | 10/1934 | Weaver | |
| 3,559,702 | A | 2/1971 | Riesenberg | |
| 5,054,527 | A | 10/1991 | Rozier | |
| 6,155,314 | A * | 12/2000 | Ding et al. | 141/285 |
| 2011/0197996 | A1 * | 8/2011 | Clusserath | 141/311 R |
| 2011/0272057 | A1 * | 11/2011 | Clusserath | 141/1 |
| 2011/0290374 | A1 * | 12/2011 | Clusserath | 141/67 |

FOREIGN PATENT DOCUMENTS

| | | | |
|---|---|---|---|
| CN | 1095687 | A | 11/1994 |
| CN | 2493607 | Y | 5/2002 |
| CN | 101291870 | A | 10/2008 |
| CN | 101668694 | A | 3/2010 |
| DE | 9412952 | | 9/1995 |
| DE | 10359312 | | 7/2005 |
| DE | 102009009340 | A1 | 8/2010 |
| EP | 0337913 | A2 | 10/1989 |
| EP | 0615947 | A1 | 9/1994 |
| EP | 0628512 | A1 | 12/1994 |
| EP | 0826626 | A1 | 3/1998 |
| EP | 1544157 | A1 | 6/2005 |
| EP | 1995208 | A1 | 11/2008 |
| IT | RE20080109 | A1 | 5/2010 |
| JP | 57133892 | | 8/1982 |
| JP | 05147695 | | 6/1993 |

OTHER PUBLICATIONS

Search Report for German Patent Application No. 10 2010 028 953.1 dated Jan. 4, 2011.
European Search Report for 11160625.7 dated Sep. 14, 2011.

* cited by examiner

*Primary Examiner* — Timothy L Maust
*Assistant Examiner* — Timothy P Kelly
(74) *Attorney, Agent, or Firm* — Marshall, Gerstein & Borun LLP

(57) ABSTRACT

A filling device for filling containers with a liquid, including several filling elements, each of the filling elements having a filling valve, a filling tube and a return gas tube, where the filling tubes of the filling elements are arranged at a first common support and the return gas tubes of the filling elements are arranged at a second common support, and where the position of the second common support can be adjusted relative to the position of the first common support.

10 Claims, 5 Drawing Sheets

FILLING DEVICE

CROSS-REFERENCE TO RELATED APPLICATION

The present application claims the benefit of priority of German Patent Application No. 102010028953.1 filed May 12, 2010. The entire text of the priority application is incorporated herein by reference in its entirety.

FIELD OF THE DISCLOSURE

The present disclosure relates to a filling device for filling containers with a liquid.

BACKGROUND

Filling devices are used, for example, in the beverage industry for filling bottles with beverages. In the process, the bottles are usually introduced into a filler with several filling elements, where each of the filling elements comprises a filling valve, a filling tube and a return vas tube. A bottle to be filled is lifted in the filler by a lifting cylinder and pressed to the filling valve outlet of a filling element by a centering bell, whereby the filling valve is opened and the product to be filled is directed from a ring bowl into the bottle.

Usually, vacuum is applied to the ring bowl with the product to be filled. The return gas tubes of the filling elements reach into the vacuum region of the ring bowl. When the bottle is pressed against the filling valve outlet, a vacuum path from the bowl into the bottle is also opened, whereby return gas can escape from the bottle into the vacuum region of the ring bowl.

As soon as the product to be filled rises above the lower opening of the return gas tube and thereby closes the vacuum path, the filling process is stopped, the bottle is withdrawn from the filling valve, and air flowing from outside into the bottle results in the excessive filled product being sucked back into the ring bowl.

However, it is a disadvantage of these known systems that the fill height can only be changed by adjusting the height of the ring bowl or by exchanging spacers, which is complicated.

Therefore, several systems have been suggested which permit to adjust the height of the return gas tube independent of the ring bowl. However, the known systems are generally mechanically very complex.

SUMMARY OF THE DISCLOSURE

It is therefore one aspect of the present disclosure to provide a device which permits to adjust the fill height in a simple manner.

The disclosure provides a filling device for filling containers with a liquid, comprising several filling elements, where each of the filling elements comprises a filling valve, a filling tube and a return gas tube, wherein the filling tubes of the filling elements are arranged at a first common support and the return gas tubes of the filling elements are arranged at a second common support, and wherein the position of the second common support can be adjusted relative to the position of the first common support.

By the possibility of adjusting the second common support relative to the first common support, the position of the return gas tubes and thus the fill height for the filling elements can be adjusted in a simple manner.

In other words, the positions of the return gas tubes can be adjustable relative to the positions of the respective filling tubes, in particular together.

The containers to be filled can be in particular bottles, for example plastic bottles or glass bottles. The liquid can be, for example, a beverage product. In other words, the filling device can be a filling device of the beverage industry.

A common support can be here in particular defined as a support which is common to the filling tubes or the return gas tubes, that means at which the filling tubes or the return gas tubes of the filling elements of the filling device are arranged.

The first and/or the second common support can be arranged above an in particular rotating tilling table. Thereby, a filler carousel can be formed.

The position of the first common support and/or the second common support can in particular correspond to a height above the filling table. In other words, the height of the second common support relative to the first common support can be adjustable.

The position of the second common support can be adjustable in particular independent of the position of the first common support. In other words, the position of the first common support can remain unchanged during an adjustment of the position of the second common support.

The position of the second common support can in particular be adjustable continuously, that means steadily. Thereby, the fill height in the container can be varied continuously.

The position of the first common support and the position of the second common support can be adjustable together. Thereby, the filling device can be adjusted to a new container type to be filled in a simple manner.

In particular, the height of the first common support and the second common support can be adjustable together.

Adjustable together can in this context in particular mean that the position of the first common support and the position of the second common support can be adjusted simultaneously, in particular parallel with respect to each other.

The filling device can in particular comprise a position adjustment means which is designed such that, by means of the position adjustment means, the position of the second common support can be adjustable relative to the position of the first common support, and/or the position of the first common support can be adjustable together with the position of the second common support.

The position adjustment means can in particular comprise:

at least one first and at least one second transmission, at least one threaded spindle, wherein the at least one threaded spindle connects the first common support and the second common support with each other, and the at least one threaded spindle can be driven, in particular rotated, by the at least one first transmission, at least one first motor, wherein the at least one first transmission can be driven by means of the at least one first motor, and at least one second motor, wherein the at least one second transmission can be driven by the at least one second motor, wherein the first common support is connected with the at least on threaded spindle by means of a threaded nut, and wherein the second common support is connected with the at least one threaded spindle by means of the at least one second transmission.

By such a position adjustment means, one can achieve in a simple manner that the position, in particular the height of the second common support, can be adjusted relative to the position, in particular the height, of the first common support.

In particular, the at least one first motor and the at least one second motor can be driven independently. The first and/or the second motor can in particular be servomotors.

The at least one first transmission can be connected with the filling table. Thereby, the at least one first transmission can remain stationary during the rotation of the at least one threaded spindle.

For example, the position adjustment means can be designed and/or configured such that the at least one second motor drives the at least one second transmission, while the at least one first motor stands still and thus does not drive the at least one first transmission. In this case, the threaded spindle does not rotate, and thereby the at least one threaded nut via which the first common support is connected with the threaded spindle neither rotates. Thus, the position of the first common support can remain unchanged in this case.

By driving the at least one second transmission by the at least one second motor, the at least one second transmission can be moved, in particular along the at least one threaded spindle. By the second common support being connected with the at least one threaded spindle via the at least one second transmission, the second common support can be moved along with the at least one second transmission. In this manner, the position of the second common support can be adjusted relative to the position of the first common support.

The position adjustment means can be designed and/or configured such that, as an alternative, the at least one first motor drives the at least one first transmission, while the at least one second motor is not operated. In this case, the threaded spindle can be rotated by the at least one first transmission. The at least one threaded nut by which the first common support is connected with the threaded spindle does not rotate and can be shifted by the rotation of the threaded spindle. Thereby, the position of the first common support can be adjusted or changed.

If the at least one second motor is not operated, the at least one second transmission can be shifted by the rotation of the threaded spindle. By the second common support being connected with the threaded spindle via the at least one second transmission, the position of the second common support can be adjusted. By the at least one threaded spindle, the position of the first common support and the position of the second common support can be adjusted together in this case.

The position adjustment means can in particular comprise several threaded spindles, several first transmissions, several second transmissions and several threaded nuts. By this, better load distribution can be achieved.

In this case, the several first transmissions can be interconnected such that they can be driven together, in particular simultaneously, by the at least one first motor. The several second transmissions can be interconnected such that they can be driven together, in particular simultaneously, by the at least one second motor.

The first common support can in particular comprise a first fixing element, wherein in particular the at least one threaded nut is arranged at the first fixing element. The second common support can in particular comprise a second fixing element, where in particular the at least one second transmission is arranged at the second fixing element.

In and/or at the first common support, a product channel can be arranged, wherein the product channel is connected with the filling tubes such that a fluid can be directed from the product channel into the filling tubes and/or vice-versa.

The filling tubes can be in particular arranged at the first common support such that a fluid can be directed laterally from the product channel into the filling tubes. In other words, the filling tubes can be arranged laterally at the first common support. Thereby, it can be easier to access the filling tubes, for example for maintenance works, than in systems known from prior art where the filling tubes are arranged underneath the ring bowl.

The filling device can moreover comprise at least one product tank which is arranged laterally adjacent to the first and the second common support and connected with the product channel such that in operation of the filling device, a fluid can be directed from the at least one product tank into the product channel. In other words, at least one product tank arranged next to the filling table can be provided. By the adjacent product tank, electric components in the region of the filler carousel can be omitted, for example level sensors.

Laterally adjacent in this context in particular means that the at least one product tank is not arranged above the filling table, in particular not above the first and the second common support.

The filling device can in particular comprise several product tanks which are arranged laterally adjacent to the first and the second common support and are connected with the product channel such that during the operation of the filling device, a fluid can be directed from the several product tanks into the product channel. By employing several product tanks, for example the product changing time for a product change can be optimized, in particular minimized.

Advantageously, at least one deaeration device is located on the filler carousel. By this at least one deaeration device, the product channel can be completely deaerated during the production preparation and correspondingly filled to the brim with product to be filled. Particularly advantageous is a deaeration means through which the product to be filled flows on its way to the product channel and which comprises an automatic air bleed valve. As the product to be filled flows through the deaeration means, gas bubbles that have possibly been supplied together with the product to be filled during the filling operation are removed from the flow of the product to be filled before they reach the product channel. Particularly preferred, the deaeration means is a deaeration vessel. Particularly preferred, the deaeration means is arranged at least partially above the product channel.

In and/or at the second common support, a vacuum channel and/or a return gas channel can be arranged, wherein the vacuum channel and/or the return gas channel is connected with the return gas tubes such that a fluid can be directed from the vacuum channel and/or the return gas channel into the return gas tubes and/or vice-versa.

In particular, the vacuum channel and/or the return gas channel can be designed separately from the product channel. Separately can in this context in particular mean that a fluid in the vacuum channel and/or in the return gas channel is not in direct contact with a fluid in the product channel. One can thereby achieve that the return gas does not come into contact with the product to be filled. A contact between the vacuum in the vacuum channel and the product to be filled can also be prevented thereby. This can be advantageous in particular for filling alcohol products as a loss of alcohol can be reduced thereby.

The vacuum channel and the return gas channel can be separate. Separate can in this context in particular mean that a fluid in the vacuum channel is not in direct contact with a fluid in the return as channel.

The vacuum channel and/or the return gas channel can be connected each with one of the return gas tubes via at least one valve. Thereby, a fluid path from one of the return as tubes each to the vacuum and/or return gas channel can be optionally opened or closed. For example, a valve to the vacuum channel can be kept closed during filling, so that no fluid can be directed from the return gas tube into the vacuum channel.

This can prevent or at least minimize, for example, a too low filling of the bottles while they are filled.

In particular, the vacuum channel and/or the return gas channel can be connected with the return gas tubes of the filling elements via at least one valve each.

The vacuum channel can be in particular connected to the return gas tubes via two or more valves. In this manner, different correction times for different bottle neck volumes can be permitted.

The vacuum channel can be connected to the product channel such that a fluid can be directed from the vacuum channel into the product channel. Thereby, in a correction phase after a container has been excessively filled above the level of a lower opening of the return gas tube, an excessively filled in amount of product can be directed first into the vacuum channel and then from there into the product channel. Thereby, a product from a correction phase can be reused.

The first common support and/or the second common support can be annular. Thereby, maintenance of the elements of the filling device can be facilitated.

The product channel can be embodied in the form of a pipeline, in particular with a circular cross-section. The product to be filled can in this case be in particular provided in an adjacent, above-described product tank from where the product can be directed into the product channel in the operation of the filling device. The diameter of the product channel can be between 1080 cm and 6480 cm, in particular between 1440 cm and 5760 cm. Thereby, a product loss in case of a malfunction, for example of the filling valve, can be kept lower than in case of a ring bowl above the filling valve known in prior art.

The disclosure moreover provides a method for adjusting a fill height during the filling of containers with a liquid, including the steps of:

providing an above-described filling device; and adjusting a position of the second common support.

Thereby, the fill height for the filling elements of the filling device can be adjusted in a simple manner.

The filling device can in particular comprise an above-described position adjustment means.

In this case, the method can comprise driving the at least one second transmission with the aid of the at least one second motor, while the at least one first motor is not driven and thus the at least one first transmission does not rotate.

In this case, the threaded spindle does not rotate and thereby the at least one threaded nut via which the first common support is connected with the threaded spindle neither rotates. Thus, in this case, the position of the first common support can remain unchanged. By driving the at least one second transmission by the at least one second motor, the at least one second transmission can be moved, in particular along the at least one threaded spindle. By the second common support being connected with the at least one threaded spindle via the at least one second transmission, the second common support can be moved along with the at least one second transmission. In this manner, the position of the second common support can be adjusted relative to the position of the first common support.

BRIEF DESCRIPTION OF THE DRAWINGS

Further advantages and features of the disclosure will be described below with reference to the exemplary figures. In the drawings.

DETAILED DESCRIPTION OF THE PREFERRED EMBODIMENT

Figure 1:
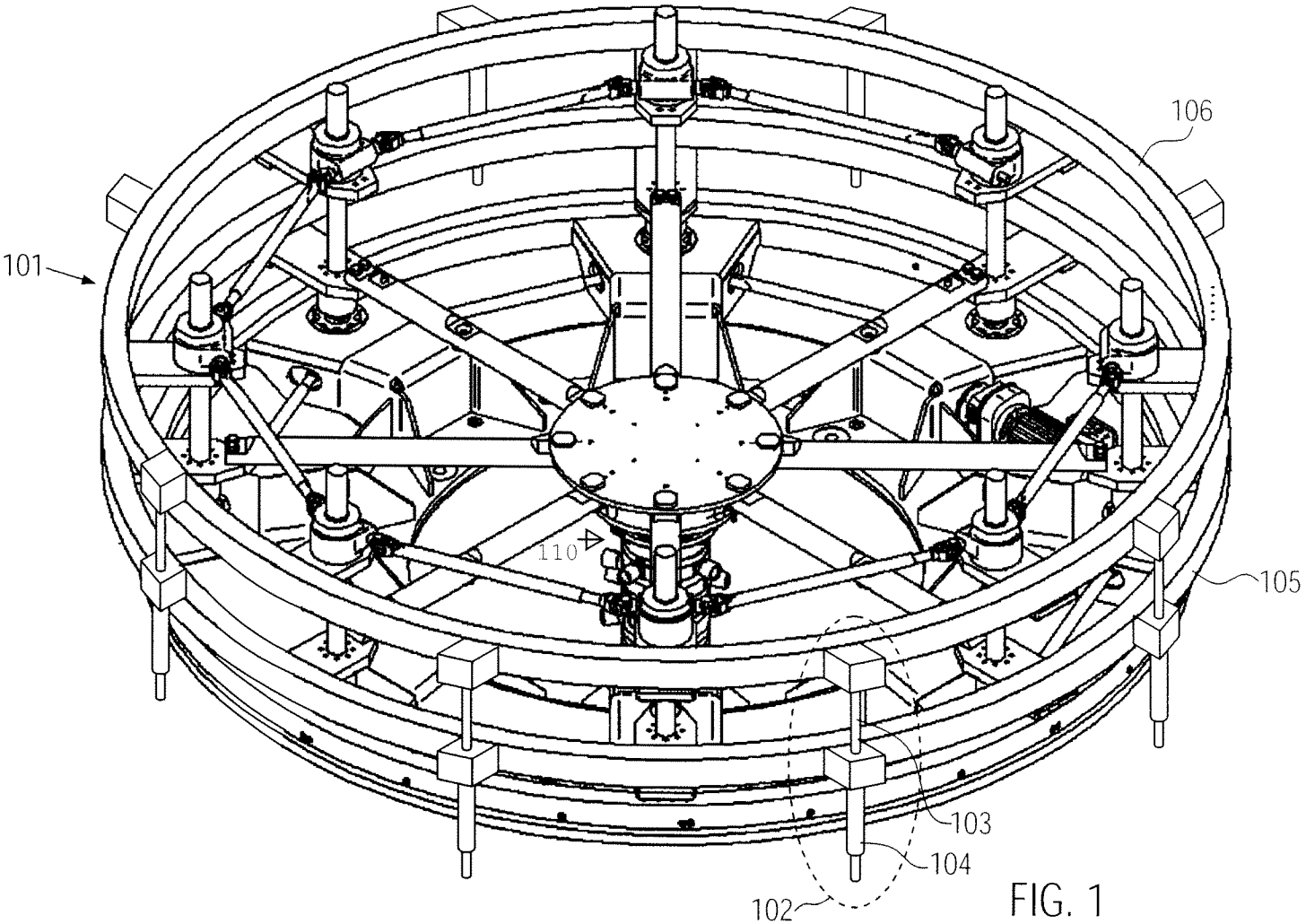
FIG. 1 shows a filler top of an exemplary filling device.

FIG. 1 shows a filler top 101 of an exemplary filling device for filling containers, for example bottles, with a liquid, for example a beverage. The filler top 101 can be mounted, for example, on a rotating filling table. In particular, the filling device can be embodied as a rotary machine.

In FIG. 1, several filling elements 102 arranged at the periphery of the filler top 101 are moreover indicated schematically. Each of the filling elements 102 comprises a return gas tube 103 and a filling tube 104, where the filling tubes 104 of the filling elements 102 are arranged at a first common support 105, and the return gas tubes 103 of the filling elements 102 are arranged at a second common support 106.

By a position adjustment means which will be described more in detail below, the position of the second common support 106 can be adjusted with respect to the position of the first common support 105. In particular, the adjustable position can correspond to a position along the axis of rotation of the filler top in operation. In other words, the adjustable position can correspond to a height over the filling table. So, the height of the second common support 106 can be adjusted relative to the first common support 105.

For example, the height of the second common support 106 relative to the first common support 105 can be varied within a range of +/−50 mm.

Figure 2:
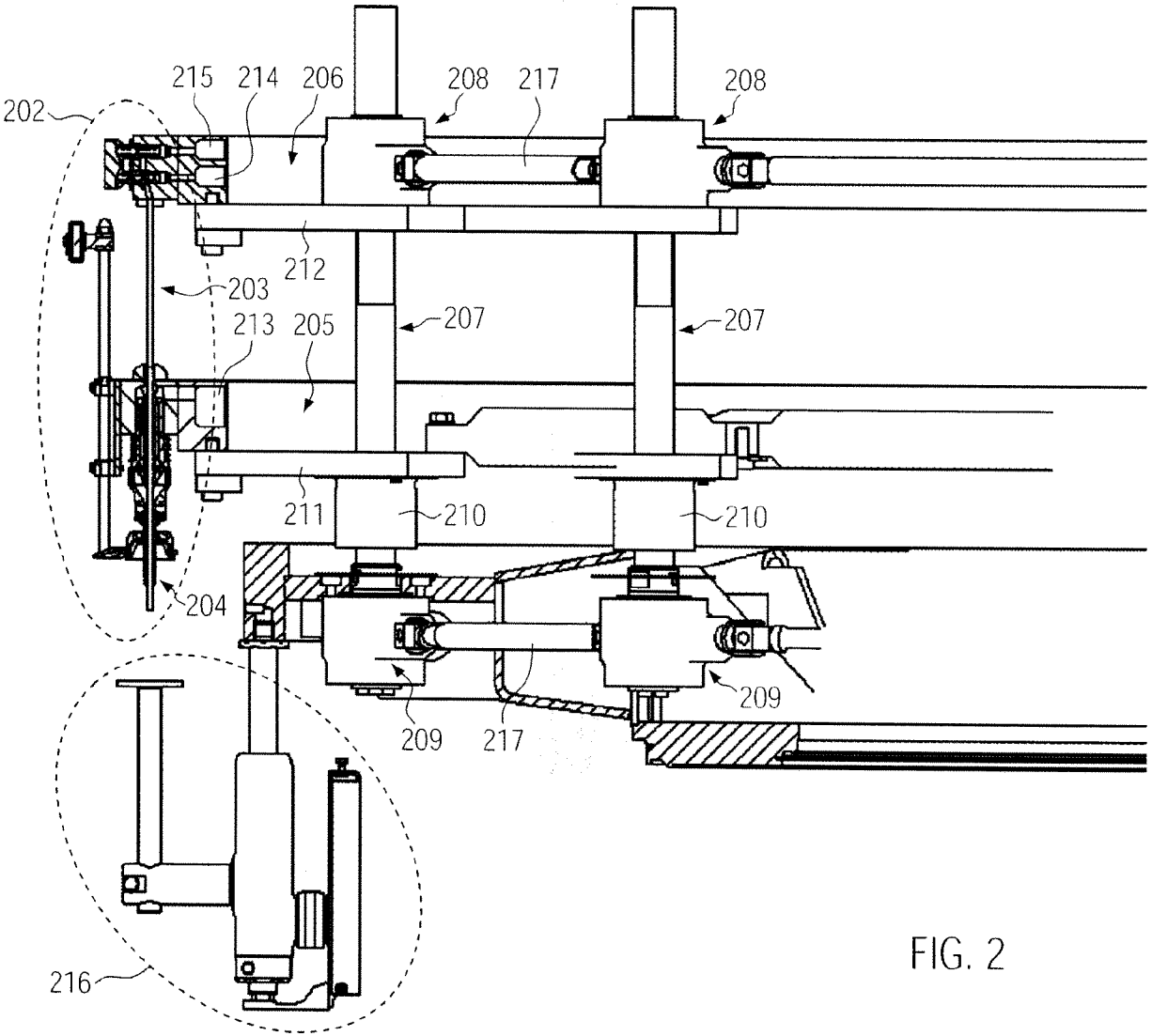
FIG. 2 shows a cross-section through a portion of an exemplary filling device.

FIG. 2 shows a portion of an exemplary filler top in a cross-section. In particular, FIG. 2 shows a filling element 202, comprising a return gas tube 203 and a filling tube 204. The filling tube 204 is arranged at a first common support 205 via a filling valve block, and the return gas tube 203 is arranged at a second common support 206 via a valve block.

The first common support 205 comprises a first fixing plate 211, and the second common support 206 comprises a second fixing plate 212.

FIG. 2 moreover shows threaded spindles 207 which connect the first common support 205 and the second common support 206 to each other. The threaded spindles 207 can be rotated by first transmissions 209. The first fixing plate 211, and thus the first common support 205, is connected with the threaded spindles 207 via threaded nuts 210. The threaded nuts 210 are axially mounted on the threaded spindles 207.

The second fixing plate 212, and thus the second common support 206, is connected with the threaded spindles 207 via second transmissions 208. The second transmissions 208 are here also axially mounted on the threaded spindles 207. The first transmissions 209 and the second transmissions 208, respectively, can be, for example, worm gear pairs. The first transmissions 209 and the second transmissions 208, respectively, are each connected by coupling elements 217, that means they each form a line of transmissions.

A first line of transmissions comprising the first transmissions 209 can be driven by a first motor, and a second line of transmissions comprising the second transmissions 208 can be driven by a second motor.

For example, the second motor can drive the second line of transmissions, while the first motor stands still and the first line of transmissions is thus not driven. In this case, the threaded spindles 207 do not rotate. Thus, the position of the first common support 205 can remain unchanged in this case.

By driving the second line of transmissions by the second motor, the second transmissions 208 can be moved along the longitudinal axes of the threaded spindles 207. By the second common support 206 being connected to the threaded spindles 207 via the second transmissions 208, the second common support 206 is moved along with the second transmissions 208. In this manner, the position of the second common support 206 relative to the position of the first common support 205 can be adjusted.

As an alternative, the first motor can drive the first line of transmissions, while the second motor is not operated. In this case, the threaded spindles can be rotated by the first transmissions 209. The threaded nuts 210 by means of which the first common support 205 is connected with the threaded spindles 207 do not rotate and are shifted by the rotation of the threaded spindles 207. Thereby, the position of the first common support 205 can be adjusted or changed.

By the second motor not being operated, the second line of transmissions is not driven. However, by the rotation of the threaded spindles 207, the second transmissions 208 can be shifted. By the second common support 206 being connected with the threaded spindles 207 via the second transmissions 208, the position of the second common support 206 can be adjusted in this manner. By the threaded spindles 207, the position of the first common support 205 and the position of the second common support 206 can be adjusted together in this case.

FIG. 2 moreover shows a product channel 213 arranged in the first common support 205. The product channel is here connected with the filling tube 204 in such a manner that a fluid can be directed from the product channel 213 into the filling tube 204 and/or vice-versa. In particular, a product can be directed from the product channel 213 via a valve into the filling tube 204.

The product to be filled is conveyed by a medium or product distributor 110 (see FIG. 1) to the product channel 213 via (non-depicted) pipelines. In the flow path between the product distributor and the product channel, a (non-depicted) deaeration means through which the product to be filled flows is arranged. The product to be filled flows from the product distributor through the deaeration means and is conveyed to the product channel via the (non-depicted) pipelines. If the filling device is filled with product to be filled in the course of the production preparation, gas bubbles can be removed from the product flow at the deaeration means, which—if such a deaeration means would be missing—would otherwise collect in the product channel, resulting in a worse filling behavior. As the (non-depicted) deaeration means is arranged above the product channel 213, the gas bubbles can, in a simple way and corresponding to their nature, rise upwards and collect in the deaeration vessel. At the deaeration vessel, an automatically operated (non-depicted) air bleed valve is arranged to regularly bleed the arising gas amounts from the deaeration vessel. As an alternative, a deaeration means can also be arranged directly at the product channel 213, where it is not crossed by the incoming product to be filled. These can be one or several so-called deaeration lanterns which are arranged radially within the product channel. It is equally possible to arrange these deaeration lanterns directly at, but above the product channel, though the described change of position between the supports 205 and 206 is impeded by this.

In the second common support 206, a return gas channel 214 and a vacuum channel 215 are arranged, wherein the vacuum channel 215 and/or the return gas channel 214 are connected with the return as tube 203 such that a fluid can be directed from the vacuum channel 215 and/or the return gas channel 214 into the return gas tube 203 and/or vice-versa.

In the vacuum channel 215, a vacuum can be provided by the vacuum pump.

In this example, the product channel 213, the return gas channel 214 and the vacuum channel 215 are embodied separately. In other words, a fluid which is located in one of the channels can be spatially separated from the fluids in the other channels. By this, a contact between the fluids present in the different channels can be avoided. By this, it can be avoided, for example, that the return gas from the bottle contacts the product to be filled, or that the vacuum from the vacuum channel 215 contacts the product to be filled in the product channel 213. By these separations, a lower loss of alcohol when alcoholic beverages are filled, and/or broken fragments and impurities in the product to be filled can be prevented.

FIG. 2 moreover shows a lifting cylinder 216 by means of which a bottle can be pressed against the filling valve outlet.

Figure 3:
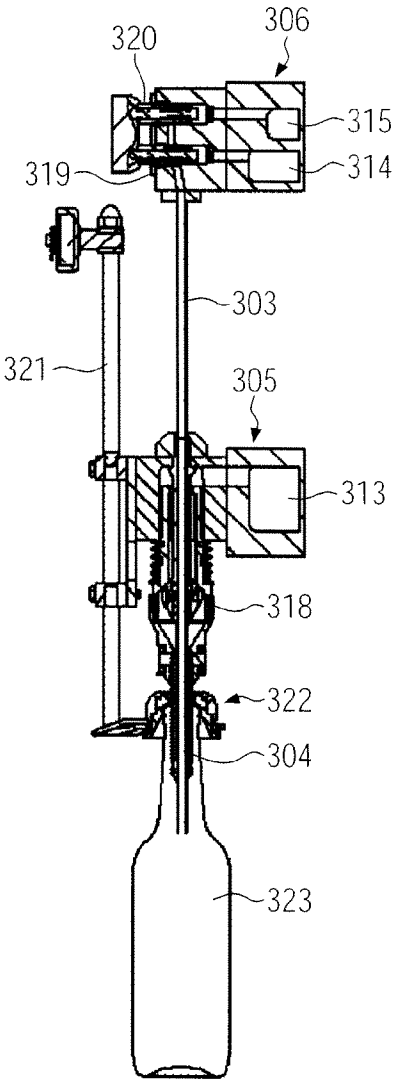
FIG. 3 shows an exemplary filling element.

FIG. 3 shows an exemplary filling element with a bottle 323 pressed against it. In particular, the exemplary filling element in FIG. 3 comprises a return gas tube 303, a filling tube 304 and a filling valve 318. In the region of the filling valve outlet, a centering bell 322 is shown via which the bottle 323 can be pressed against the filling valve outlet. The centering bell 322 is arranged at a rod assembly 321 which can be moved relative to the filling valve 318. By this, the centering bell 322 can be moved in the direction of the filling valve 318 while the bottle 323 is pressed against it.

In FIG. 3, the first common support 305 and the second common support 306 are also indicated. A product channel 313 arranged in the first common support 305 is here connected with the filling tube 304 such that a product can be directed from the product channel 313 into the filling tube 304 via the filling valve 318.

The exemplary filling element of FIG. 3 is in particular arranged laterally at the first common support 305 and the second common support 306. By this, a replacement and/or maintenance of the filling element can be facilitated as compared to a filling element arranged under a ring bowl as known in prior art.

In the indicated second common support 306 in FIG. 3, a return gas channel 314 and a spatially separate vacuum channel 315 are moreover provided. The return gas channel 314 is connected with the return gas tube 303 via a first valve 319 so that it can be switched. In other words, a fluid path from the return gas channel 314 into the return gas tube 303 and vice-versa can be switched by the valve 319, that means opened or closed. The vacuum channel 315 is also connected with the return gas tube 303 via a second valve 320 so that it can be switched. By this, a fluid path from the return gas channel 315 into the return gas tube 303 can be switched by the valve 320, that means opened or closed.

FIGS. 4*a* to 4*d* show an exemplary filling operation using the filling element shown in FIG. 3 by way of example.

Figures 4A, 4B, 4C, 4D:
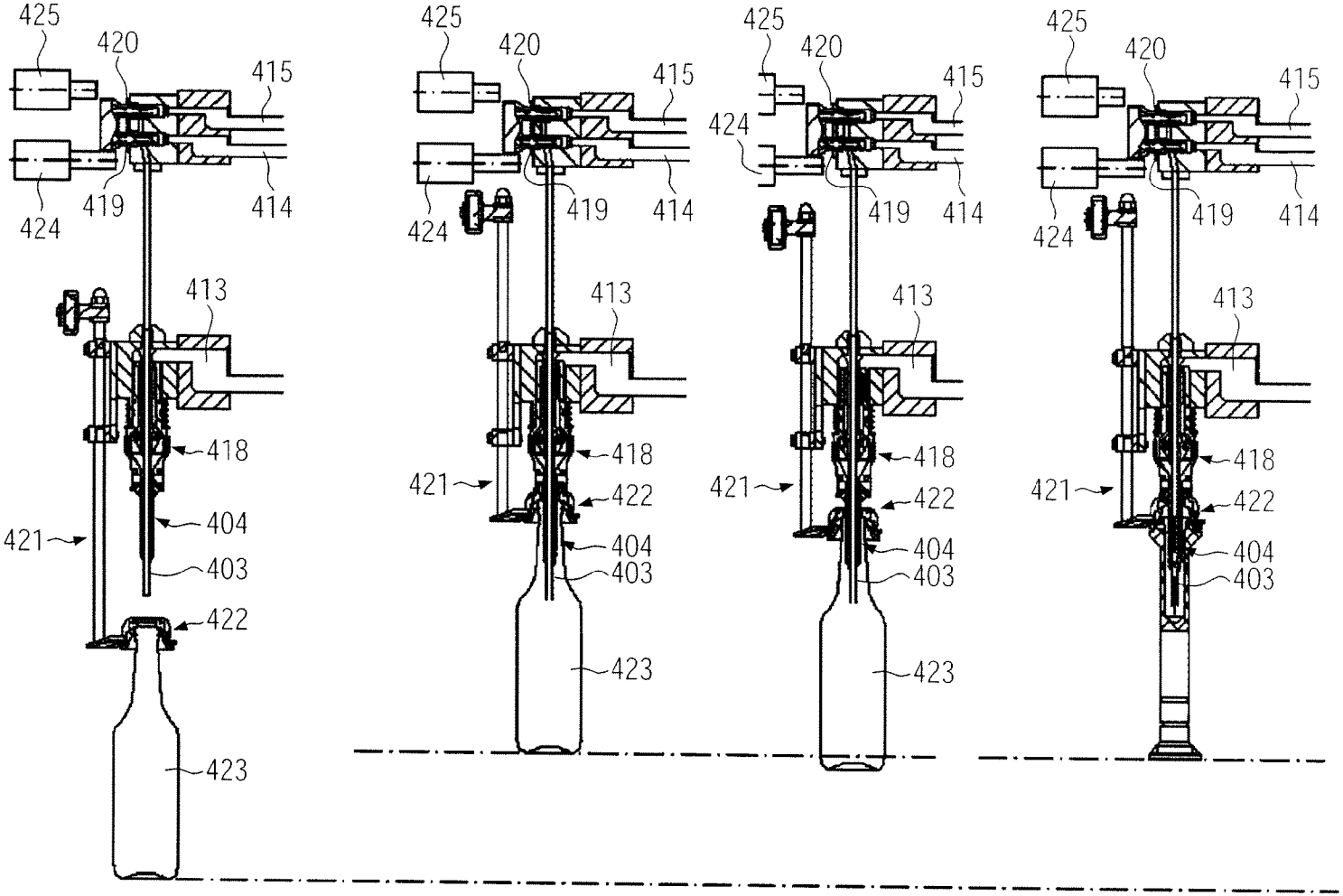
FIGS. 4*a*-4*d* show an illustration of an exemplary filling operation.

FIG. 4*a* shows how an exemplary bottle 423 is transferred to the exemplary filling element. The exemplary bottle 423 can here be, for example, located on a lifting cylinder as is represented in FIG. 2. The bottle 423 is lifted by such a lifting cylinder and the bottle mouth is centered in its position by a centering bell 422. By further lifting the cylinder, the centering bell 422 is moved towards the filling valve block in which the filling valve and at least partially the filling tube 404 are arranged. For this, the rod assembly 421 at which the centering bell 422 is arranged can be moved relative to the filling valve block.

FIG. 4*b* shows the bottle 423 in a state pressed to the lower end of the filling valve block. While the bottle 423 is pressed against it, the filling valve 418 is opened, so that a product can be directed from the product channel 413 via the filling tube 404 into the bottle 423. The product to be filled then flows along the inner wall of the bottle 423 into the bottle. By pressing on the bottle 423, the valve 419 was also opened via a control block 424, so that return gas escaping from the bottle can be directed into the return gas channel 414 via the return gas tube 403. As the return gas channel 414 is spatially separated from the product channel 413, the return gas from the bottle does not contact the product to be filled in the product channel 413.

The bottle is in this manner filled until the liquid level of the filled product blocks the return gas path via the return gas tube 403, that means until it has risen above the level of the lower opening of the return gas tube 403 in the bottle 423.

Thereupon, the bottle 423 is, as is shown in FIG. 4*c*, withdrawn from the filling valve block whereby the filling valve 418 is closed. By lowering the bottle 423, air can flow from outside into the bottle 423. As soon as the bottle 423 has been completely lowered to the correction stroke, the control block 424 closes the valve 419, whereby the fluid path from the return gas tube 403 into the return gas channel 414 is closed. The control block 425 thereupon opens the valve 420, whereby a vacuum path is opened, that means a fluid can be directed from the return gas tube 403 into the vacuum channel 415. As a vacuum prevails in the vacuum channel 415, the excessively filled product is sucked into the vacuum channel 415. By the vacuum channel 415 being embodied to be separate from the product channel 413, the excessive product does not come into contact with the product to be filled.

After such a correction phase, the valve 420 is closed by the control block 425, the bottle 423 is completely lowered by the lifting cylinder and drives on the filler carousel over a discharge starwheel.

Upon completion of the filling, in particular before a changeover to a new product to be filled, the filling element can be cleaned, in particular by CIP cleaning (Cleaning in Place), as is illustrated in FIG. 4*d*.

Teflon bellow valves can also be preferably employed as control blocks 425, 426.

The product sucked into the vacuum channel 415 in the above-described correction phase can be directed into a separation container via a liquid separator. The liquid separator can be arranged in particular upstream of a vacuum pump of the vacuum channel 415.

The product sucked off into the vacuum channel 415 in the above-described correction phase can alternatively be returned into the product channel 413 via a connecting channel between the vacuum channel 415 and the product channel 413. This permits to reuse the sucked off product, which is important, for example, in filling wine as this can be a very precious product to be filled.

For example, the corrected product can be returned into the product channel 413 in a valve manifold 530 over the liquid separator upstream of the vacuum pump. As a precaution, the product is here preferably processed before it is returned, for example by filtration or by blending it with original product to be filled.

Figure 5:
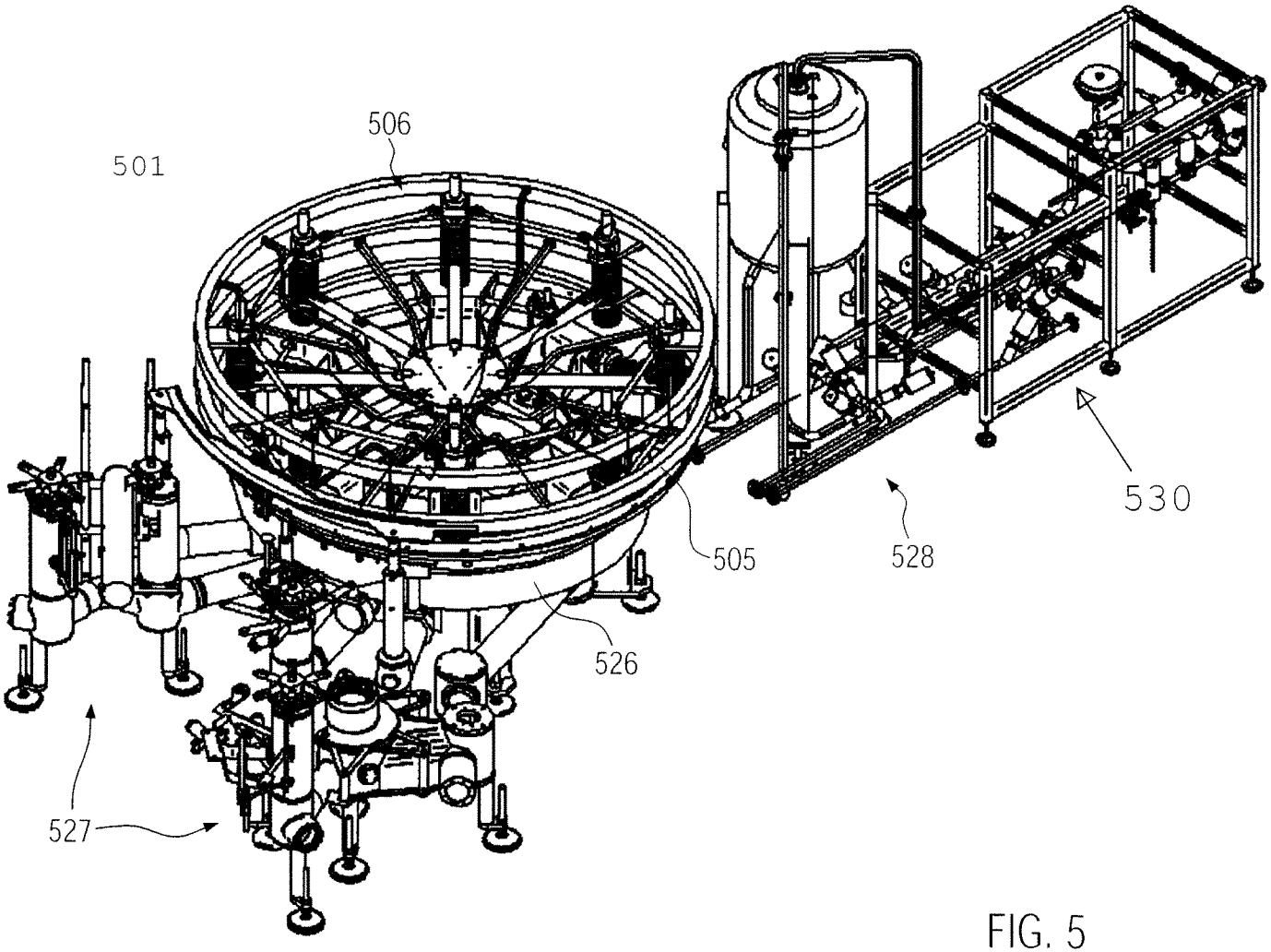
FIG. 5 shows an exemplary filling device.

FIG. 5 shows an exemplary filling device, comprising a filler top 501 with a first common support 505 and a second common support 506. The filling elements which are arranged at the filler top 501 are not shown in FIG. 5 for a better overview. A corresponding representation can be found in FIG. 1. The filler top 501 is arranged on a rotating tilling table 526 with a fixed height. The filling table 526 and the filler top 501 together form a so-called filler carousel.

Reference numeral 527 designates a pre-table system at which, for example, (non-depicted) transport starwheels or one or several (non-depicted) closing machines downstream of the filling device are arranged.

In FIG. 5, an adjacent product tank 528 is moreover shown which is arranged laterally adjacent to the filler carousel, in particular to the first and the second common support 505 and 506, respectively. The product tank 528 is connected with a product channel arranged in the first common support 505 such that during the operation of the filling device, a product can be directed from the product tank 528 into the product channel. By the combination of a product channel and an adjacent product tank, the product channel can have a smaller volume than a ring bowl in prior art. Thereby, the product loss during a malfunction of the filling device can be reduced. In particular, an emergency-stop function can be provided. For this, the filling device can comprise a shut-off valve between the adjacent product tank 528 and the filler carousel. In case of a malfunction of a filling element, for example a filling valve, leakage of a major amount of product can thereby be prevented.

In case of a product change, the adjacent product tank and the product channel can be drained by pressing the product back into a customer tank and then filled with a new product. Before the new product is filled, the filling valves of the filling elements can be drained via a drain curve.

Several adjacent product tanks can also be used. Thereby, the product changing times and the product loss during a change of a product to be filled can be further optimized, in particular minimized.

By an adjacent tank 528, moreover electric components, such as for example level sensors, can be avoided in the filler carousel. This can be an advantage on the one hand for cost reasons, on the other hand for safety reasons, for example if high-proof spirits are filled and thus a risk of explosion may exist.

In the adjacent product tank 528, an overpressure can in particular prevail, in particular where the overpressure is reached by supplying a gas via an incoming line.

It will be understood that features mentioned in the above described embodiments are not restricted to these special combinations and are also possible in any other combinations.

The invention claimed is:

1. Filling device for filling containers with a liquid, comprising:

a plurality of filling elements, each of the filling elements having a filling valve, a filling tube, and a return gas tube, the filling tubes of the filling elements being arranged at a first common support, the return gas tubes of the filling elements being arranged at a second common support, the position of the second common support being adjustable relative to the position of the first common support, and at least one threaded spindle connecting the first common support and the second common support to each other.

2. Filling device according to claim 1, wherein the position of the first common support and the position of the second common support can be adjusted together.

3. Filling device according to claim 1, wherein in and/or at the first common support, a product channel is arranged, wherein the product channel is connected with the filling tubes such that a fluid can be directed from the product channel into the filling tubes and/or vice-versa.

4. Filling device according to claim 3, wherein the filling tubes are arranged at the first common support such that a fluid can be directed laterally from the product channel into the filling tubes.

5. Filling device according to claim 3, and comprising at least one product tank, which is laterally adjacent to the first and the second common support and is connected with the product channel such that during the operation of the filling device, a fluid can be directed from the at least one product tank into the product channel.

6. Filling device according to claim 1, wherein in and/or at the second common support, a vacuum channel and/or a return gas channel is arranged, wherein the vacuum channel and/or the return gas channel is connected with the return gas tubes such that a fluid can be directed from the vacuum channel and/or the return gas channel into the return gas and/or vice-versa.

7. Filling device according to claim 6, wherein the vacuum channel and the return gas channel are separate.

8. Filling device according to claim 6, wherein the vacuum channel and/or the return gas channel are each connected with one of the return gas tubes via at least one valve.

9. Filling device according to claim 6, wherein the vacuum channel is connected with a product channel arranged in and/or at the first common support and connected with the filling tubes, such that a fluid can be directed from the vacuum channel into the product channel.

10. Filling device according to claim 1, wherein the first common support and/or the second common support have an annular design.

* * * * *